US005327605A

United States Patent [19]

Cragg

[11] Patent Number: 5,327,605

[45] Date of Patent: Jul. 12, 1994

[54] ENERGY-ABSORBING SPAN LOCK SYSTEM FOR DRAWBRIDGES

[75] Inventor: Robert L. Cragg, Maple Glen, Pa.

[73] Assignee: Steward Machine Co., Inc., Birmingham, Ala.

[21] Appl. No.: 40,420

[22] Filed: Mar. 31, 1993

[51] Int. Cl.[5] ..... E01D 15/08

[52] U.S. Cl. ..... 14/41; 14/46

[58] Field of Search ..... 14/35, 38, 41, 46

[56] References Cited

U.S. PATENT DOCUMENTS 685,768 11/1901 Keller .
689,856 12/1901 Cummings .
2,610,341 9/1952 Gilbert ..... 14/41

FOREIGN PATENT DOCUMENTS 929130 6/1955 Fed. Rep. of Germany .
163881 2/1964 Fed. Rep. of Germany ..... 14/41

OTHER PUBLICATIONS

Hovey, O. E., *Movable Bridges,* John Wiley & Sons, New York 1927, vol. II, pp. 68 and 73.
Hool, G. A. et al., *Movable and Long Span Steel Bridges,* McGraw-Hill 1923, 2nd Ed., pp. 144-145.

*Primary Examiner*—Ramon S. Britts
*Assistant Examiner*—James A. Lisehora
*Attorney, Agent, or Firm*—Howson and Howson

[57] ABSTRACT

An energy absorbing span lock system for drawbridges, such as a double-leaf bascule leaf span. A retractable and extendible connector mounted on one leaf of the span engages a receiver on the other leaf. Resilient energy absorbing shoes in the receiver accept the connector and allow relative deflection between the leaf ends caused by vehicular traffic.

21 Claims, 8 Drawing Sheets

ENERGY-ABSORBING SPAN LOCK SYSTEM FOR DRAWBRIDGES

BACKGROUND OF THE INVENTION

The present invention relates generally to span locks for drawbridges, and more particularly to a novel and improved energy absorbing span lock system suitable for use in drawbridges.

Span locks on drawbridges serve as shear connectors for securing the outer ends of movable leaves from vertical deflection such as occurs during passage of vehicular traffic, and for preventing the bridge from accidentally opening. As applied to a double-leaf bascule bridge, the locks couple the outer ends of the leaves in vertical alignment where they meet and transfer the shear loads from one leaf to the other.

Several types of locks for these purposes are well-known. For example, U.S. Pat. Nos. 685,768 to C. L. Keller and 689,856 to E. D. Cummings provide interlocking members for vertically aligning the outer ends of bascule bridge leaves where they meet, and for transmitting shear stresses from one leaf to the other. The bascule bridge in U.S. Pat. No. 2,610,341 to H. H. Gilbert utilizes a bar lock consisting of self-aligning members on one leaf registering with retractable shear pins on the other leaf. In German Patent No. 929,130 to K. Seegers, the drawbridge has a span lock in which spring-loaded locking levers on one leaf snap into place on either side projection on the other leaf as the span closes.

Bar-type and jaw-type span locks have been particularly favored because of their reliability. The bar-type lock utilizes forged steel, machine-finished bars slid within guides and sockets on the outer or meeting ends of the drawbridge. The bar lock is especially susceptible to wear requiring frequent interruptions of bridge service for time-consuming repair or replacement of parts. Some bar locks have shims in the guides and sockets for adjusting the positions of the openings and for controlling clearance with the bar. Even so, service interruptions are still necessary for adjustments and shim replacement. Where shims or other means for adjustment are not provided, complete disassembly and removal of span lock components are usually required.

The jaw-type span lock provides extendable jaws on one bridge leaf which rotate on eccentric pins in a vertical plane into a socket on the other bridge leaf. The vertical clearance between the jaws and the socket is usually adjusted by rotating the eccentric pins. Generally, pins are difficult to move after long use and exposure to the environment, and are not in readily accessible locations.

Vertical clearance in each of these span lock systems is critical. Vertical clearance in the range of 0.020 inches is preferred yet, after a short service time, it is not uncommon for the clearance to become excessive. In some instances, vertical movement of one end of a meeting bridge end relative to the other increases as much as 1.5 inches or more. In addition to the risk of vehicular accidents and personal injury, excessive vertical clearance is insidious and will continue to increase and manifest damage or failure as well to structural members or operating machinery due to greater shock loading.

Ideally, the vertical opening in either system should be equal to the height of the bar, or distance between the jaws, so that substantially no clearance exists upon contact, and that shear loads are smoothly transmitted from one member to the other. However, minimizing the vertical clearance is not easily achieved. In one bar-type system the guides and sockets are equipped with upper and lower shoes urged against the bar by tapered wedges. As wear occurs, the vertical clearance between the bar and the shoes can be reduced by adjusting the wedges. The wedges, however, are not a significant improvement over guides and sockets fitted with shims. Both designs require frequent adjustment to insure proper alignment.

Another known bar-type span lock design is self-adjusting. It utilizes a tapered bar slidable in a guide and a socket in respective leaves of the bridge. As the bar or socket wears, the bar is urged further into the socket to take up the wear. The position of the bar in the socket is controlled by limit switches. This design accommodates wear in the socket of one leaf, but does not correct for wear in the bar guide.

While the above-described designs have unique advantages over prior concepts, they do not address the problem of repetitive shock loads experienced by span locks in drawbridges due to heavy traffic.

SUMMARY OF THE INVENTION

Accordingly, it is an object of the present invention to provide for a drawbridge a span lock system which will vertically align the outer sections of the bridge where they meet when closed and maintain uniform deflection of the ends under conditions of asymmetrical loading.

Another object is to provide for drawbridges an energy absorbing span lock system which eliminates vertical clearance between the interlocking components.

Still another object is to provide for drawbridges a continuously self-adjusting span lock system which compensates for wear while cushioning shock loads.

A further object is to provide for drawbridges a span lock system which is of relatively simple design for ease of manufacture, installation, repair, and replacement of parts.

These and other objects of the invention are accomplished in a drawbridge by means of an energy absorbing span lock system in which connector means mounted on the outer end of one leaf of the span engages receiver means on the outer end of the other leaf of a double leaf bascule bridge. At least the receiver means has energy absorbing shoes slidably receiving the connector means and resilient means associated with the shoes for resiliently accommodating shocks and relative deflection between the leaf ends caused by vehicular traffic across the bridge.

BRIEF DESCRIPTION OF THE DRAWINGS

For a more complete understanding and appreciation of the invention and of the many attendant advantages thereof, reference will be made to the following details and description taken in conjunction with the accompanying drawings, wherein.

DESCRIPTION OF THE PREFERRED EMBODIMENTS

Figure 1:
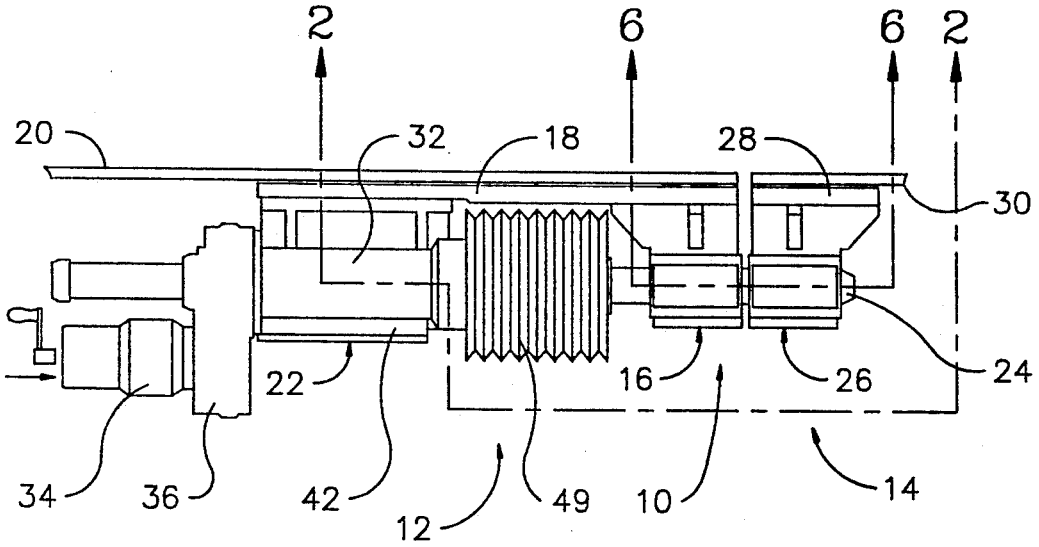
FIG. 1 is a fragmentary plan view of the outer ends of a double-leaf bascule bridge locked in a lower or closed position by an energy absorbing span lock system according to the invention.
Figure 2:
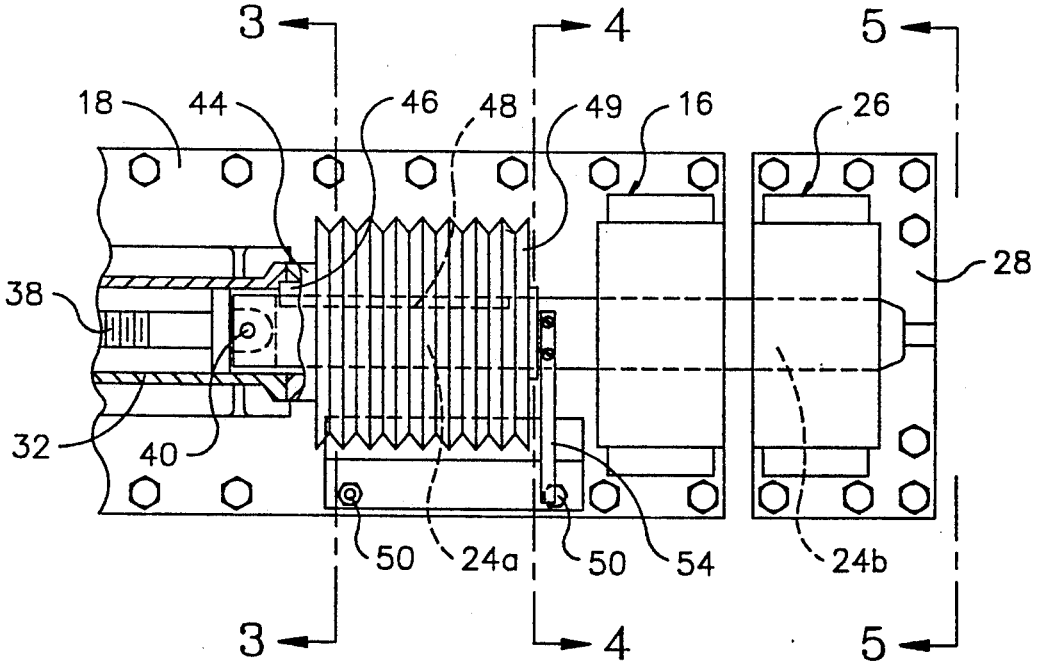
FIG. 2 is an elevational view of a portion of the span lock system taken, partially in cross-section, along the line 2—2 of FIG. 1.

Referring now to the drawings wherein like reference characters designate like or corresponding parts throughout the several views, a novel span lock system 10 is shown in FIGS. 1 and 2 operatively connecting the meeting or outer ends of leaves 12 and 14 of a double leaf bascule bridge. Of course, it will be appreciated that the system is also applicable to other forms of drawbridges where there is at least one movable leaf, or span. For instance, in a single leaf bascule bridge, the leaf pivots relative to a stationary end support at the opposite end of the bridge span.

Figure 3:
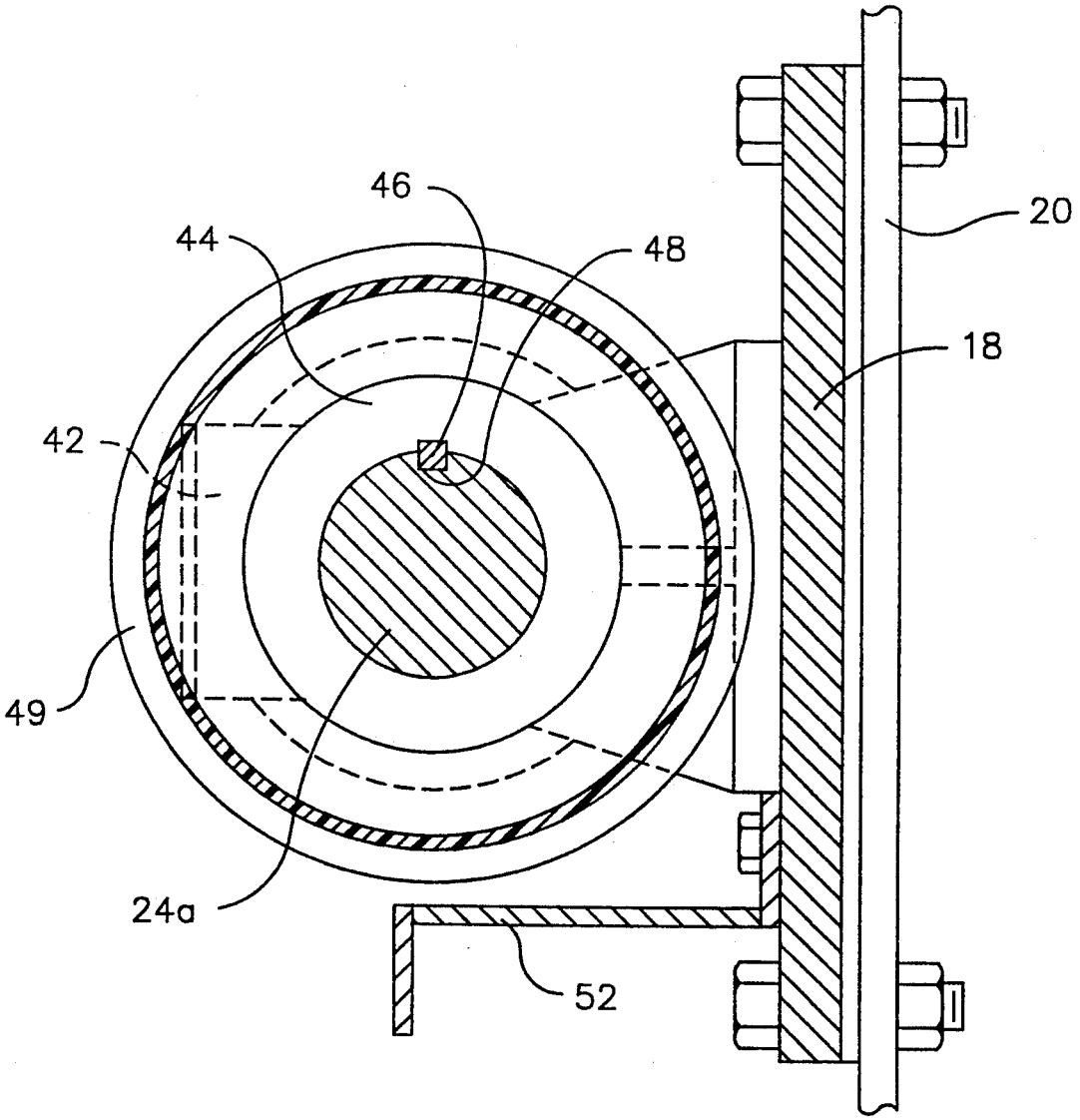
FIG. 3 is an enlarged elevational cross-sectional view of the span lock system taken along the line 3—3 of FIG. 2.

According to the present invention, system 10 includes a bar guide assembly 16 having a base 18 fixed to a girder web 20 of leaf structure 12, adjacent its free-end, and a lock bar assembly 22, mounted on guide base 18. Assembly 22 includes an elongate lock bar 24, or shear member, having a proximal portion 24*a* of circular cross section providing a connector means (FIGS. 2 and 3) slidable in a cylinder 32 of assembly 22, and a distal portion 24*b* of rectangular cross section (FIGS. 2 and 4) slidably supported in guide means assembly 16. Distal portion 24*b* also selectively extends into a bar socket assembly 26 having a socket base 28 secured to a girder web adjacent the free end of 30 bridge leaf structure 14. The bar socket assembly 26 provides a receiving means for the connector means 24. The upper and lower ends of bar portion 24*b* are beveled to accommodate slight misalignments with assembly 26 during insertion. While in the ilustrated embodiment, the free ends of a double leaf bridge are shown, it should be apparent that in a single leaf bascule bridge, the end opposite the free end of the moveable span is fixed. Thus, in such a bridge, the span structure 14 may be moveable, and its complementary structure 12 stationary, or vice versa.

For purposes of displacing the shear member 24, an electric motor 34, through a gear train 36, drives a screw 38 coaxially coupled within cylinder 32 by a clevis 40 to lock bar proximal section 24*a*. Limit switches, not shown, within a compartment 42 externally mounted on cylinder 32, are electrically connected to motor 34 and determine the limits of travel of screw 38 and lock bar 24. A collar 44 fixed to the end of cylinder 32 includes a key 46 interengaging a lengthwise slot 48 in proximal bar portion 24*a* for preventing transfer of torsion in screw 38 to distal bar portion 24*b* and guide assembly 16. A bellows-like protective boot 49, sealingly mounted around lock bar proximal portion 24*a*, expands and collapses axially as screw 38 moves between the limit switches in compartment 42. The position of lock bar 24 at the limits of extension and retraction is indicated by remote means, not shown, electrically actuated by proximity switches 50 longitudinally spaced on a bracket 52 secured to guide base 18. Switches 50 respond to the proximity of an actuator arm 54 fixed to and laterally extending from bar 24 to provide indicia to a bridge tender when the span lock system is fully extended or retracted.

Figure 4:
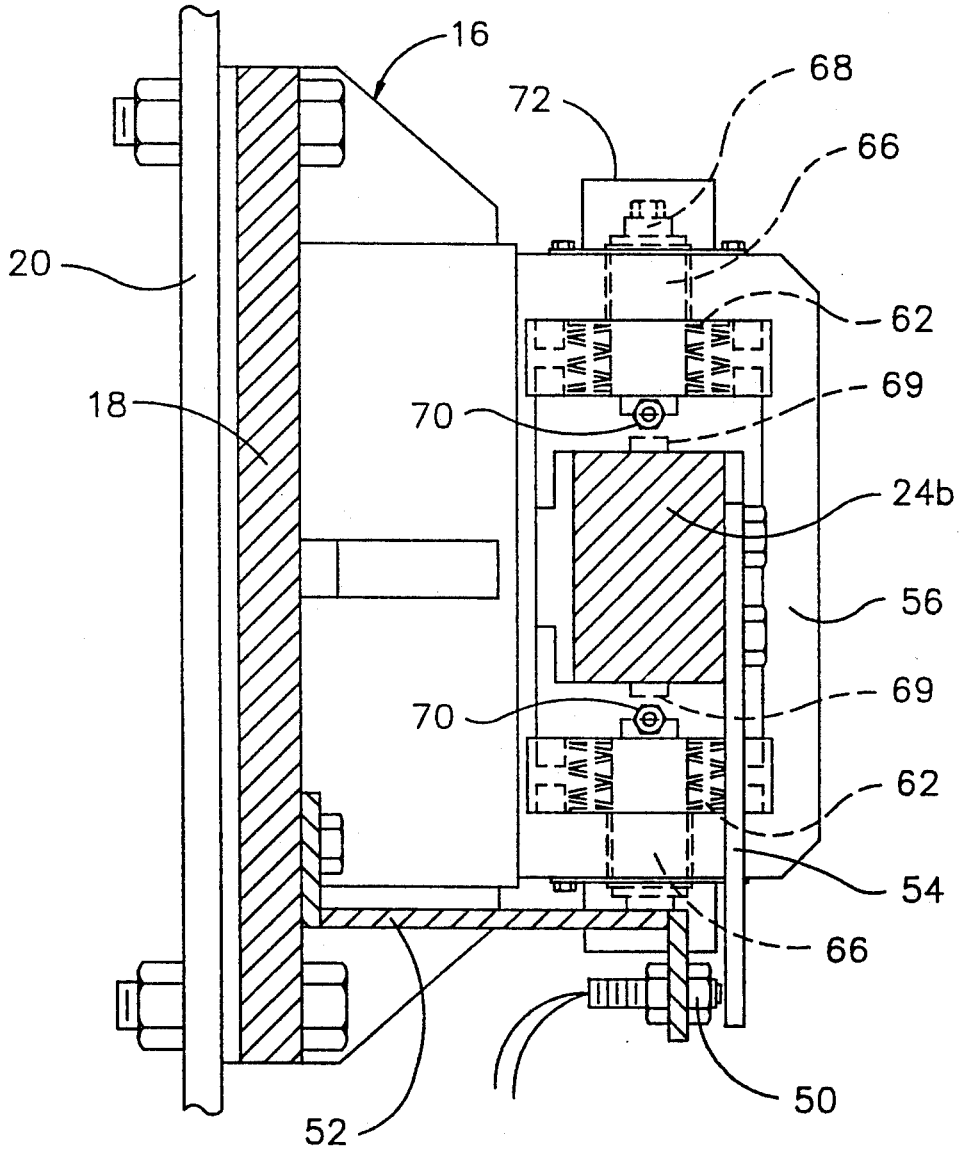
FIG. 4 is an enlarged elevational cross-sectional view of the span lock system taken along the line 4—4 of FIG. 2.
Figure 5:
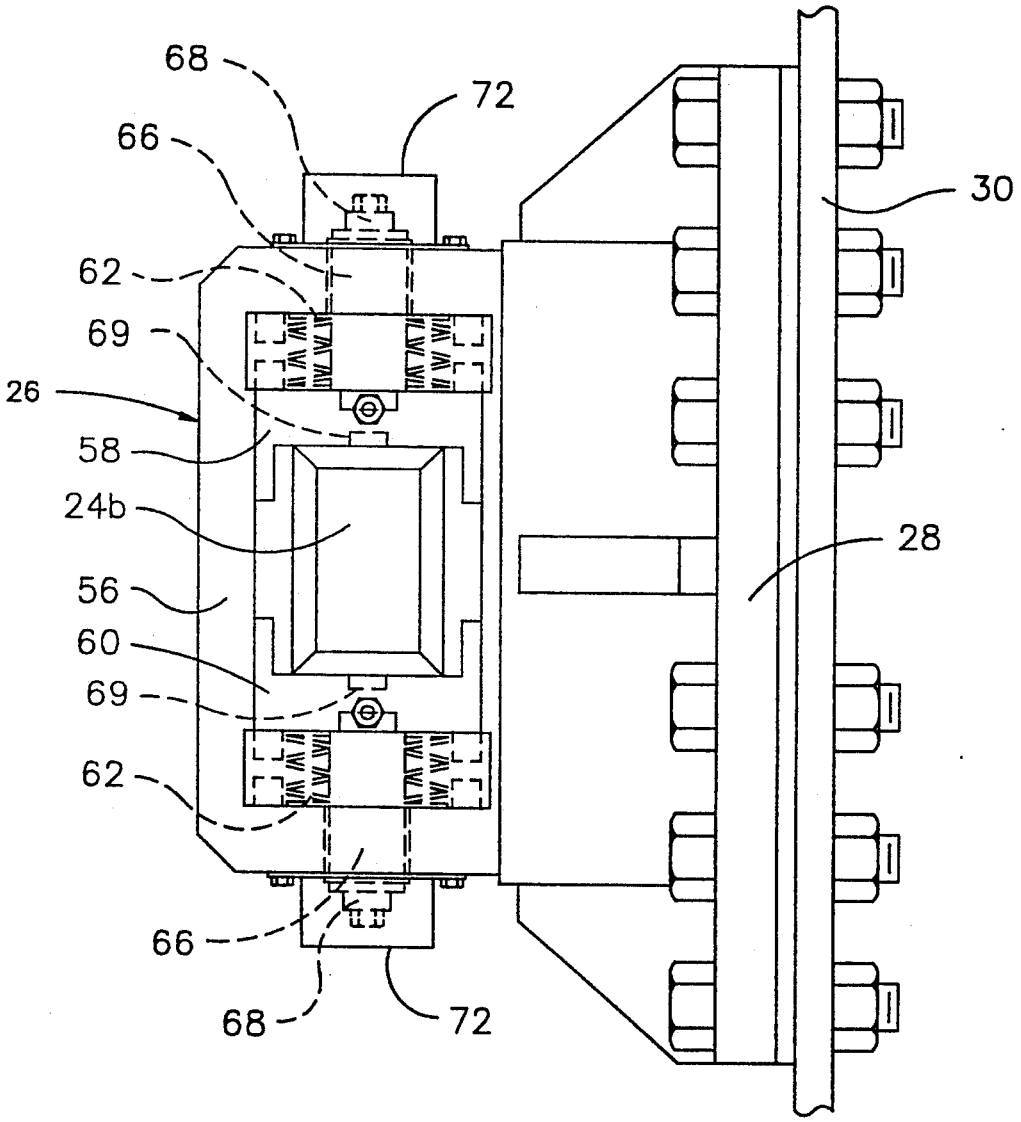
FIG. 5 is an end view in elevation of the span lock system taken along the line 5—5 of FIG. 2.
Figure 6:
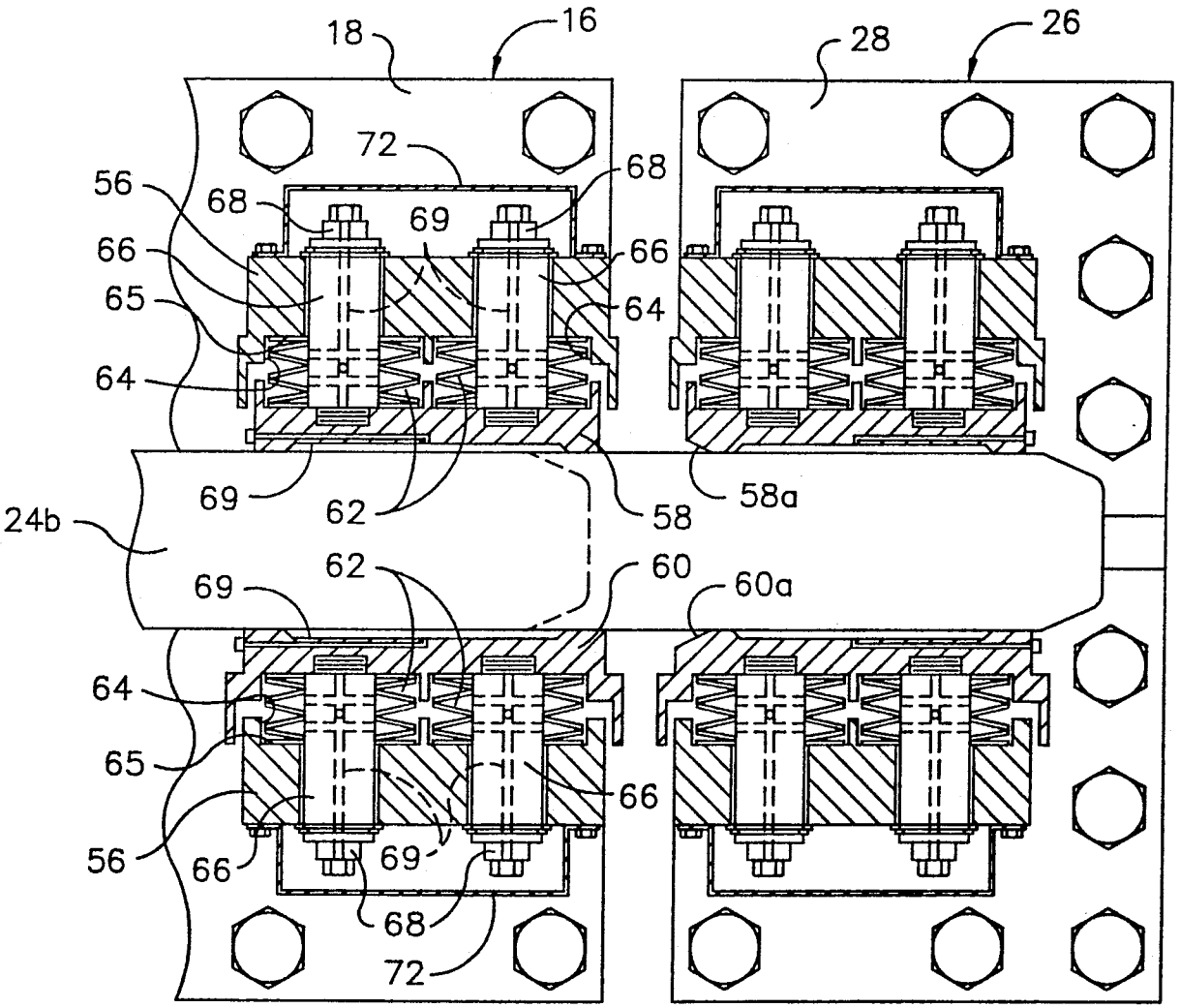
FIG. 6 is an elevation view of a guide and a socket of the span lock system taken in cross section along the line 6—6 of FIG. 1.

Bar guide assembly 16 provides a resilient, energy-absorbing vertical support for lock bar 24. Referring to FIGS. 4 and 6, assembly 16 includes a housing 56 for receiving lock bar distal portion 24*b* between vertically slidable upper and lower shoes 58 and 60. Each of the shoes is resiliently urged in continuous contact with an upper or lower flat surface of lock bar distal portion 24*b* by two parallel series of Belleville washers, or springs, 62 compressed between the shoes and a shoulder 65 in each of cylindrical chambers 64 of housing 56. Thus, vertical misalignment and shock caused by vehicular traffic and the like is accommodated. Distributors 66 in each chamber 64 provide passages for lubricating springs 62 from externally mounted button-head lube fittings 68, and passages 69 in each shoe provide for lubricating the interface with lock bar 24 from conduits, not shown. Covers 72 secured to housing 56 are provided for protecting fittings 68.

Bar receiving socket assembly 26 is structurally identical to bar guide assembly 16 but for socket base 28 being configured to support only assembly 26, and socket shoes 58 and 60 having beveled edges 58*a* and 60*a* like the end of bar 24 at the outer end of bridge leaf 14 for accommodating slight vertical misalignments during insertion.

As illustrated in solid outline in FIGS. 2 and 6, lock bar 24 is fully extended in a locked position when the outer ends of bridge leaves 12 and 14 meet and bar guide assembly 16 registers with bar socket assembly 26. In the unlocked position, shown in broken outline, lock bar 24 is completely retracted by motor 34 from bar socket assembly 26 allowing bridge leaves 12 and 14 to move independently of each other.

Figure 7C:
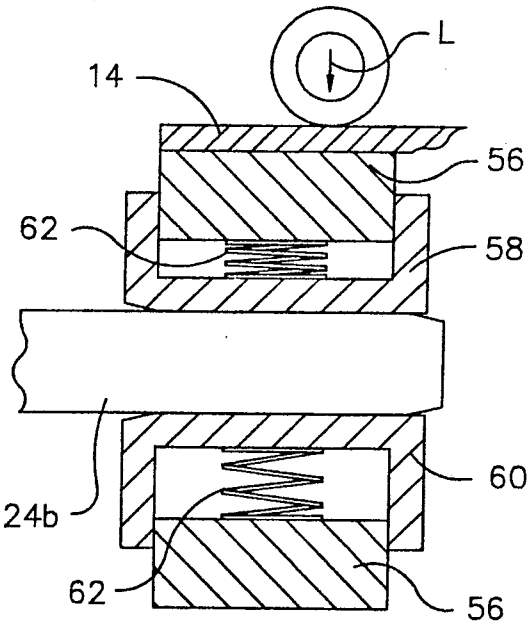
FIGS. 7*a*, 7*b* and 7*c* are schematic representations of a portion of a span lock system according to the invention in three stages of operation.
Figure 7B:
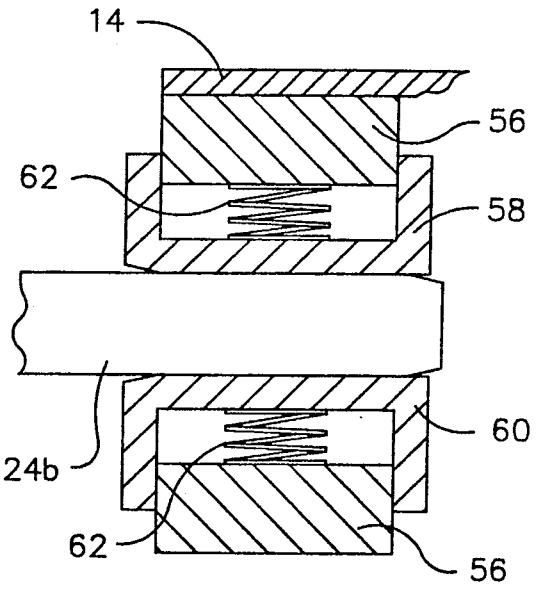
Figure 7A:
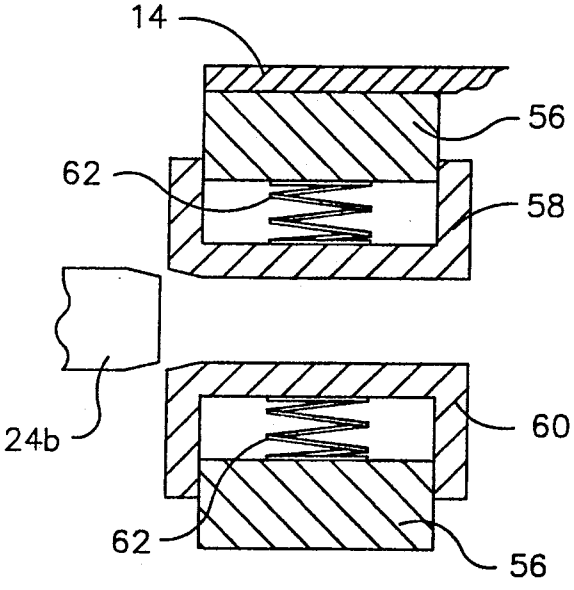

Operation of the bar socket assembly 26 is schematically illustrated in FIGS. 7*a*, 7*b* and 7*c* in three stages with the lock bar 24 at a constant elevation. In FIG. 7*a*, bar 24 is retracted allowing upper and lower socket shoes 58 and 60 to be fully extended by springs 62 toward each other. In FIG. 7*b*, there is no load deflecting bridge leaf 14, but shoes 58 and 60 are outwardly deflected from each other by the force of protruding lock bar 24 against springs 62. In FIG. 7*c*, a sudden load L causes downward deflection of bridge leaf 14 with respect to lock bar 24. This compresses spring 62 in upper shoe 58 and expands spring 62 in lower shoe 60 providing thereby energy absorption of the shock. Bar guide assembly 16 responds in a like manner.

In the illustrated embodiment, the lock bar is extended and retracted lengthwise of the span in the direction of vehicular traffic. There may be applications in which a transverse mounting may provide some advantages. Also, in the illustrated embodiment a vertically moveable span is shown; however, the present invention has applicability to other forms of span locks, such as those which pivot horizontally about a vertical axis.

Figure 8:
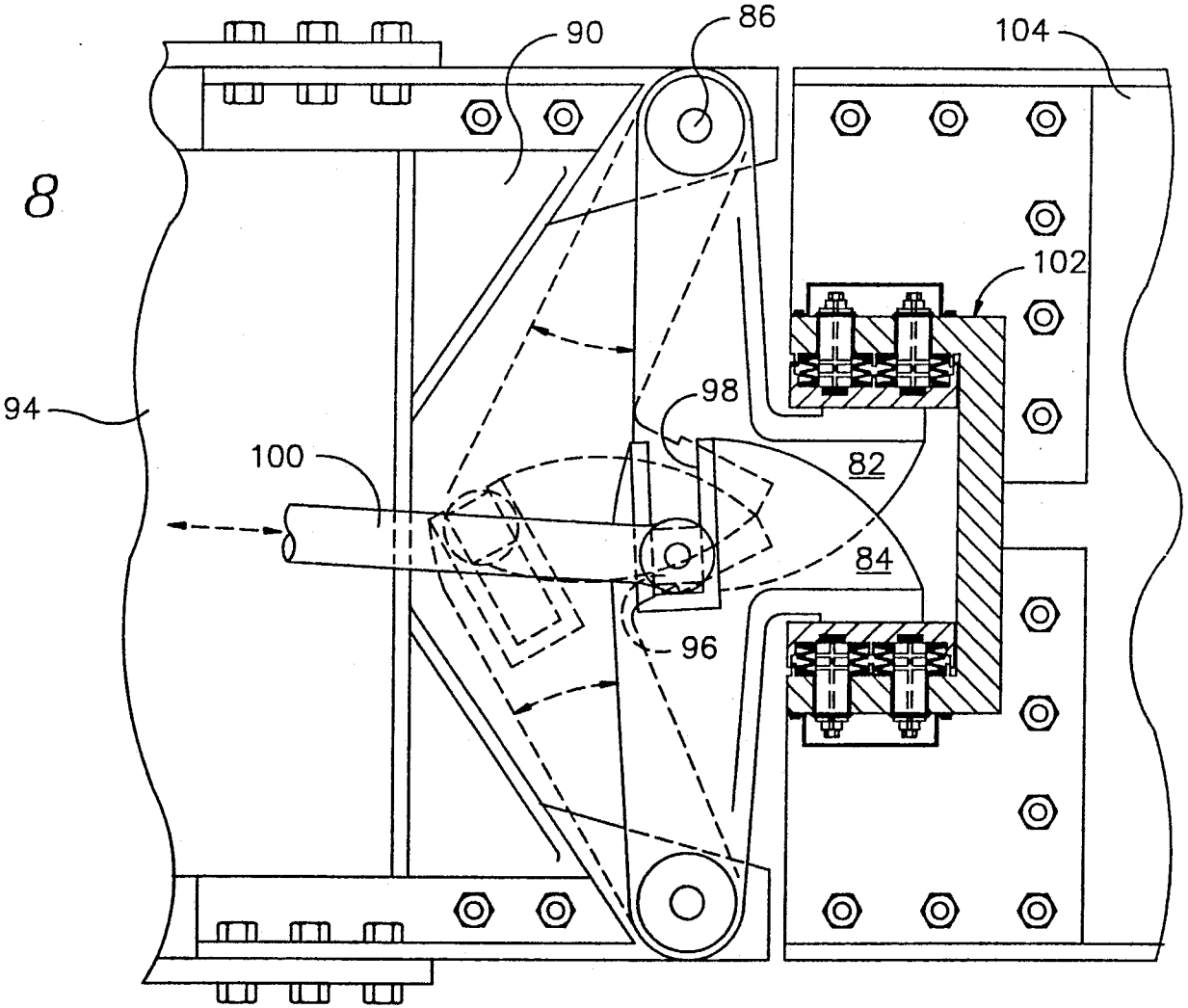
FIG. 8 is an elevation view, partially in cross-section, of another embodiment of the span lock system according to the invention utilizing movable jaws.

Referring now to FIG. 8, there is shown another embodiment of the span lock system employing a jaw-type interlock. Upper and lower jaws 82 and 84 respectively pivot in a vertical plane about pins 86 and 88 extending from a support frame 90 mounted on a structural member 94 at the outer end of a bridge leaf. Jaws 82 and 84 are simultaneously operated in opposite directions by a Scotch yoke type of mechanism which includes a block 96 rotatably connected to jaw 82 on an axis displaced from pin 86 and slidably engaged in a radial slot 98 in jaw 84. An actuating rod 100 pivotally connected at one end to block 96 is movable in either lengthwise direction by means not shown to cause jaws 82 and 84 to rotate between a locking position shown in solid lines and an unlocking position shown in dash-dot outline. In the locking position, jaws 82 and 84 engage a jaw socket assembly 102 supported on a structural member 104 at the meeting end of the opposing bridge leaf. Assembly 102 includes a housing 106 with upper and lower jaw socket shoes 108 and 110 respectively compressed against jaws 82 and 84 by Belleville springs 112 in the same manner as the above-described span lock system 10.

Operation of the jaw-type span lock system of FIG. 8 is as follows. In the unlocked position shown in dash-dot outline, jaws 82 and 84 are rotated inwardly by rod 100. When the outer ends of the bridge leaves are closed and substantially aligned, rod 100 is moved outward until jaws 82 and 84 rotate into engagement with respective shoes 108 and 110 and compress springs 112, as shown in solid outline. Like the bar-type system, any vertical misalignment or deflection due to shock such as from vehicular traffic will be absorbed by springs 112.

Figure 9:
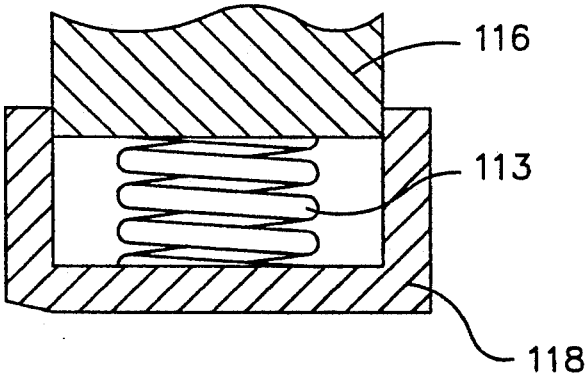
FIGS. 9-12 are alternate embodiments in cross section of energy absorbers for the span lock system according to the invention.
Figure 10:
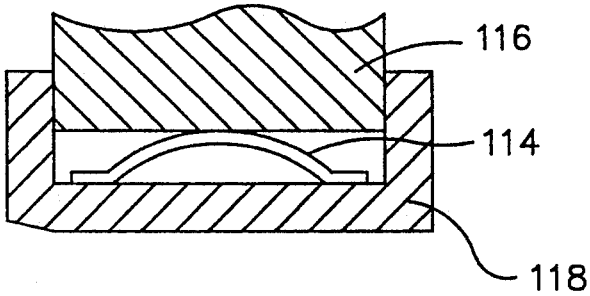
Figure 11:
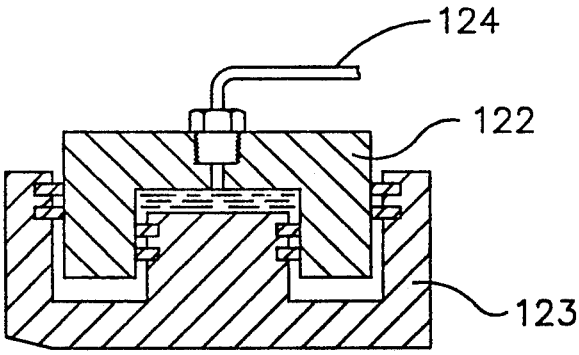
Figure 12:
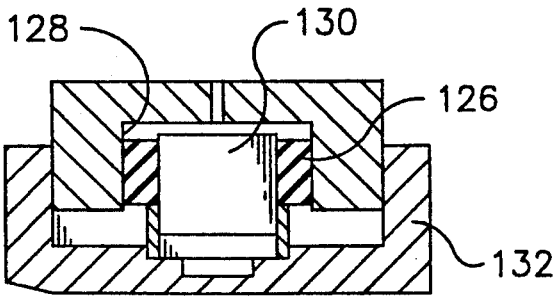

Other forms of energy absorbing devices in place of Belleville springs 62 and 110 are contemplated. FIGS. 9 and 10 illustrate a coil spring 113 and a leaf spring 114, respectively, disposed between a housing 116 and a shoe 118 of a guide or socket assembly. FIG. 11 illustrates a fluidic dashpot 120 disposed between a housing 122, an upper shoe 123 which is connected by a conduit 124 to similar dashpot, not shown, in a lower shoe. Fluid resistively transfers back and forth between the dashpots as the loading vertically oscillates. FIG. 12 is still another energy absorbing device which utilizes a rubber or similar elastomeric bushing 126 concentrically secured between a cylindrical recess 128 in the housing and a mating boss 130 extending from a shoe 132.

Some of the many advantages and novel features of the invention should now be readily apparent. For example, a span lock system for drawbridges is provided which will vertically align the outer sections of the leaves of the bridge where they meet when closed, and maintain uniform deflection of the ends due to shock caused by vehicular traffic or the like. The shoes in the system may be pre-loaded to keep both shoes in firm contact with the lock bar to eliminate "slamming" of the bar against the shoes. The system automatically and continuously adjusts for wear to the extent of the pre-load amount. Shock loads resulting from the passage of vehicular traffic are cushioned and alignment between the meeting ends of the bridge leaves ensures passage of moving vehicles across the span. The design can be suitably modified to carry any magnitude of shear loads, and uniform shoe contact with the lock bar is assured across the full length of the shoes.

It will be understood that various changes in the details, materials, steps and arrangement of parts, which have been herein described and illustrated in order to explain the nature of the invention, may be made by those skilled in the art within the principle and scope of the invention as expressed in the appended claim.

I claim:

1. For use in combination with a drawbridge having at least one span with a free end structure moveable with respect to a complementary structure, span lock apparatus for releasably interlocking the free end structure with its complementary structure in a manner providing a shear connection therebetween, said apparatus comprising:

a connector mounted on one of the structures, said connector having a shear member extendable and retractable relative to said one structure;

receiver means mounted on the other of the structures for receiving an extended portion of said shear member and for aligning and interlocking the structures when the drawbridge is closed; and first resilient means mounted on said receiver means for resiliently engaging opposed upper and lower surfaces of said extended portion of said shear member;

whereby shear loads applied to the span are resiliently accommodated.

2. Apparatus according to claim 1 wherein:

said receiver means includes a housing, opposed first shoes in said housing movable transversely with respect to the path of movement of the shear member; and said first resilient means is disposed between said housing and at least one of said first shoes for urging said first shoes against said opposed surfaces of said shear member.

3. Apparatus according to claim 2 wherein said first resilient means includes a series of Belleville springs.

4. Apparatus according to claim 2 wherein said first resilient means includes a helical spring.

5. Apparatus according to claim 2 wherein said first resilient means includes a leaf spring.

6. Apparatus according to claim 2 wherein said first resilient means includes a dashpot.

7. Apparatus according to claim 2 where in said first resilient means includes an elastomeric element secured at inner and outer peripheral surfaces thereof between said housing and said shoes.

8. Apparatus according to claim 1 further comprising: guide means mounted on said one of said structures for guiding said shear member during extension and retraction relative to said receiver means.

9. Apparatus according to claim 2 wherein said connector further includes actuator means for extending and retracting said shear member, and limiter means operatively connected to said shear member and said actuator means for restricting the travel of said shear member to a predetermined range.

10. Apparatus according to claim 2 wherein: said connector includes pivotally connected jaws for interengaging said first shoes, and actuator means for rotating, extending and retracting said jaws.

11. In a bascule bridge having at least one moveable leaf structure, an energy absorbing span lock system for releasably interlocking the moveable leaf with a complementary structure, comprising:

a connector mounted on one of the structures, said connector having an extendable and retractable portion for spanning between said structures;

a receiver means mounted on the other of the structures for receiving the extendable and retractable portion of the connector and for aligning and interlocking the structures when the bridge is closed; and resilient means mounted on said other of the structures for resiliently engaging opposite upper and lower surfaces of the extendable and retractable portion; whereby shear loads can be transferred across the structures in a manner that absorbs shocks and accommodates wear.

12. A system according to claim 11 wherein:

said receiver means includes a housing, opposed shoes independently movable in said housing in a direction transverse to the connector, and said resilient mean includes at least one shock absorber disposed between said housing and at least one of said shoes for urging said shoe into contact with opposed sides of said connector.

13. A system according to claim 12 wherein said shock absorber is selected from the group consisting of Belleville springs, helical springs, leaf springs, and elastomeric springs.

14. A system according to claim 12 including a pair of said shock absorbers disposed between both shoes, and means fluidly interconnecting said pair of shock absorbers.

15. A system according to claim 12 wherein said shock absorber includes an elastomeric element secured between said housing and said shoe.

16. A system according to claim 11 further comprising guide means mounted on said one structure for guiding said connector means during extension and retraction.

17. A system according to claim 11 wherein said other structure includes another leaf of a double leaf bascule bridge.

18. A system according to claim 11 where said shoes are disposed in vertically spaced relation on said opposite sides of said connector means.

19. Apparatus according to claim 17 wherein said bridge is of the double leaf bascule type and wherein said moveable span structure is one leaf and said other structure is the other leaf, and said shear connector member extends lengthwise of the bridge span.

20. Apparatus according to claim 13 wherein said receiver means includes an opposed pair of shoes slidably receiving said connector means, and said resilient means includes an elastic element engaging each of said shoes.

21. In a bridge having at least one moveable span structure with a free end portion adapted to be juxtaposed with another structure to form a load support surface, and a releasable shear connection between the structures for limiting relative motion therebetween, the improvement wherein the releasable shear connection comprises:

a shear connector member carried on at least one of said structures, actuator means for selectively extending and retracting said shear connector member, receiver means on the other of said structures for receiving said shear connector member when extended; and resilient means disposed between said receiver means and upper and lower surfaces of said shear connector member for accommodating motion of the shear connector member caused by loading of the span while transferring shear loads from one structure to the other, whereby shock loads on the span and wear on the shear connector member can be accommodated.

* * * * *